United States Patent [19]

Merritt et al.

[11] 4,446,607

[45] May 8, 1984

[54] APPARATUS AND METHOD FOR FORMING AN EXTERNAL GUARD MEMBER ON A HOSE

[75] Inventors: Paul H. Merritt, East Peoria; Francis W. Fuller, Peoria, both of Ill.

[73] Assignee: Caterpillar Tractor Co., Peoria, Ill.

[21] Appl. No.: 294,758

[22] PCT Filed: Jul. 30, 1981

[86] PCT No.: PCT/US81/01025

§ 371 Date: Jul. 30, 1981

§ 102(e) Date: Jul. 30, 1981

[87] PCT Pub. No.: WO83/00455

PCT Pub. Date: Feb. 17, 1983

[51] Int. Cl.[3] ..... B23P 23/04

[52] U.S. Cl. ..... 29/33 E; 29/434; 29/782

[58] Field of Search ..... 29/33 E, 456, 33 F, 29/460, 434, 779, 780, 782, 781; 72/145; 140/93 R, 92.1, 92.2; 156/143, 144; 138/110

[56] References Cited

U.S. PATENT DOCUMENTS

| | | | |
|---|---|---|---|
| 1,004,643 | 10/1911 | Gilson | 29/780 X |
| 1,295,835 | 3/1919 | Andren | 29/780 |
| 2,779,383 | 1/1957 | Johnson | 29/782 X |
| 2,865,424 | 12/1958 | McElroy | 29/782 X |
| 3,053,288 | 9/1962 | Burbank | 140/92.1 |
| 3,524,244 | 8/1970 | Cullen et al. | 29/780 X |
| 3,823,883 | 7/1974 | Fenci | 29/780 X |

*Primary Examiner*—William R. Briggs

*Attorney, Agent, or Firm*—Robert A. McFall

[57] ABSTRACT

This invention relates to an apparatus (10) and a method for forming, in situ, an external guard member (12), preferably of a spring steel wire material, on a hose (14).

Spring steel wire is highly desirable as a material for guard members. Heretofore it has been necessary to preform the spring steel wire on a coiling machine and install precut lengths of the coil onto partially assembled hoses.

The present invention overcomes the above problems of construction and assembly by providing an apparatus (10) and method for forming the preferred spring steel wire guard member (12) in situ on a hose (14) having fittings preassembled on both ends. The apparatus (10) includes a forming head (20) having separable first and second portions (46,48). A plurality of radially spaced die members (60) are provided on the first and second portions (46,48) to fully form two complete coils of a guard member (12). The apparatus (10) and method of the present invention is particularly useful for forming spring steel wire guard members on high pressure hydraulic hoses subjected to severe service applications.

13 Claims, 10 Drawing Figures

APPARATUS AND METHOD FOR FORMING AN EXTERNAL GUARD MEMBER ON A HOSE

DESCRIPTION

1. Technical Field

This invention relates generally to an apparatus and method for forming an external guard member in situ on a hose and more particularly to an apparatus and method for forming a spring steel wire guard member about the exterior surface of a reinforced hydraulic hose.

2. Background Art

Guard members for hoses, and in particular, coiled wire protectors for high pressure hydraulic hoses, are well known and generally referred to as armored hose or hose having an armor guard. The guard members are particularly useful on hydraulic hoses installed on construction machinery, serving to protect such hoses from cuts, abrasion, and crushing. Generally, the guard member is a coiled steel wire or band having an inside diameter larger than the outside diameter of the hose. The guard member thus encircles the hose in a spaced relationship to permit the hose to flex freely within the guard member.

Spring steel wire is highly desirable as a material for guard members. However, heretofore it has been necessary to preform the spring steel wire on a coiling machine having a solid mandrel, cut the preformed coil to a predetermined length, and then slide the preformed coil onto a length of hose having a fitting assembled on only one end. The preformed coil was installed over the second end of hose, the second end being the end opposite the assembled end. After installation of the spring steel coil on the hose, it was necessary to compress the coil longitudinally along an elongate central axis of the hose, in a direction toward the first or assembled hose end, to expose a length of hose near the second end sufficient for the application of a temporary clamp. After clamping, assembly of the hose was completed by installing a fitting on the second hose end. Finally, the temporary clamp was released and the guard member allowed to expand back to the original uncompressed length.

As may be easily appreciated, the above method for constructing an armored hose presents a number of problems. First, it is difficult to install, clamp, and compress the spring coil member on a partially assembled hose. Secondly, it must be determined in advance which hoses are to receive the protective guard member since the coil spring guard member could not be installed on a hose after fittings were installed on both ends. Thus, it has been necessary to interrupt the hose assembly process after a fitting was installed on only a first end of the hose.

In response to the above problems, an alternate guard member construction is often used. In the alternate construction, an elongated soft steel strap or band is used for the guard member in lieu of the aforementioned spring steel wire. The soft steel strip can be easily formed in the shape of a coil without the aid of a solid mandrel and can therefore be formed in situ on a hose. An assembled hose, that is a hose having fittings installed on both ends, is positioned in an open die, and the soft steel strip is formed in a coil around the hose. However, easy formability of the soft steel strip material also yields a guard member that may also be easily crushed in use. A guard member that has been crushed or otherwise deformed may restrict the flow capacity of the hose and will generally abraid the hose surface adjacent the crushed zone resulting in premature hose failure.

The present invention is directed to overcoming one or more of the problems as set forth above by providing an apparatus and method for forming the preferred spring steel wire guard member in situ on a hose having fittings preassembled on both ends.

DISCLOSURE OF THE INVENTION

In accordance with one aspect of the present invention, an apparatus for forming a guard member on a hose includes a frame, a means for supporting the guard member or the hose, or both, a means for feeding a continuous strand of guard material to the apparatus, and a two-piece forming head, at least one part being moveable with respect to the frame.

In another aspect of the present invention, a method for forming an external guard member on a hose includes placing a hose in a two-piece forming head, closing the head about the hose, and feeding a continuous strand of guard material to the forming head. In the forming head, the guard material is initially urged into a first coil shape having a first predetermined diameter and thereafter formed into a second coil shape having a second diameter greater than the first diameter.

Heretofore it has not been possible to form a spring steel wire guard member about the exterior surface of a hose having fittings attached at both ends. Due to the tendency of spring steel wire to "spring back" or return to an earlier position when bent to a second position, it is necessary to form spring steel wire by either overbending or by pressure forming against a solid surface such as a mandrel. The present invention solves the problem of forming a spring steel wire member about a resilient member, such as a hose, by providing an apparatus and method for urging a continuous strand of guard material into a first coil shape having a diameter less than the desired final-formed diameter of the guard member. As a result of the unique two-piece split die arrangement of the present invention, a hose having fittings preassembled on each of the hose ends, can be placed between the dies and, after closing of the dies, a spring steel wire guard member may be formed about the hose from one fitting end to the other.

BEST MODE FOR CARRYING OUT THE INVENTION

Figure 1:
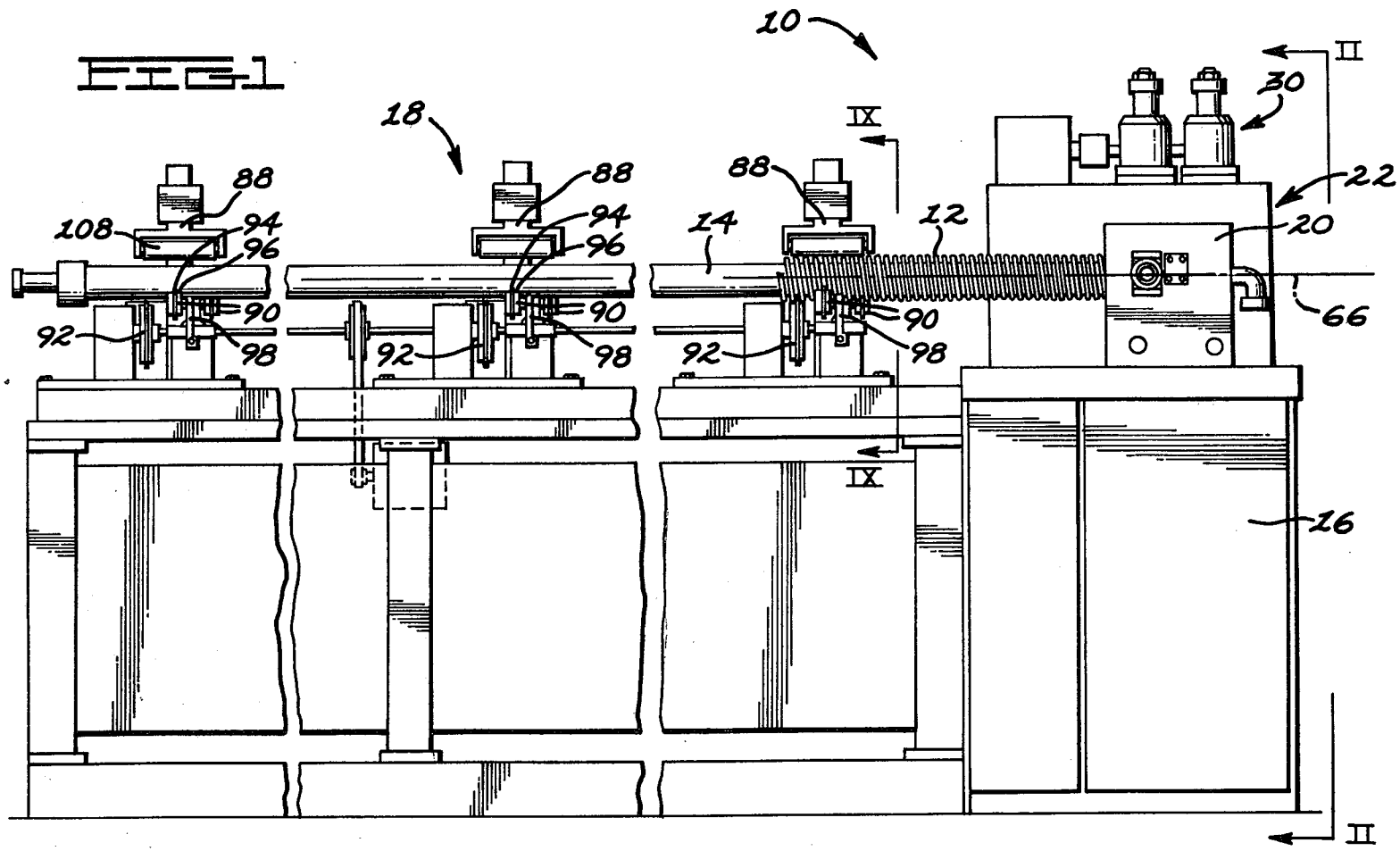
FIG. 1 is a front elevational view of an embodiment of the apparatus of the present invention.
Figure 2:
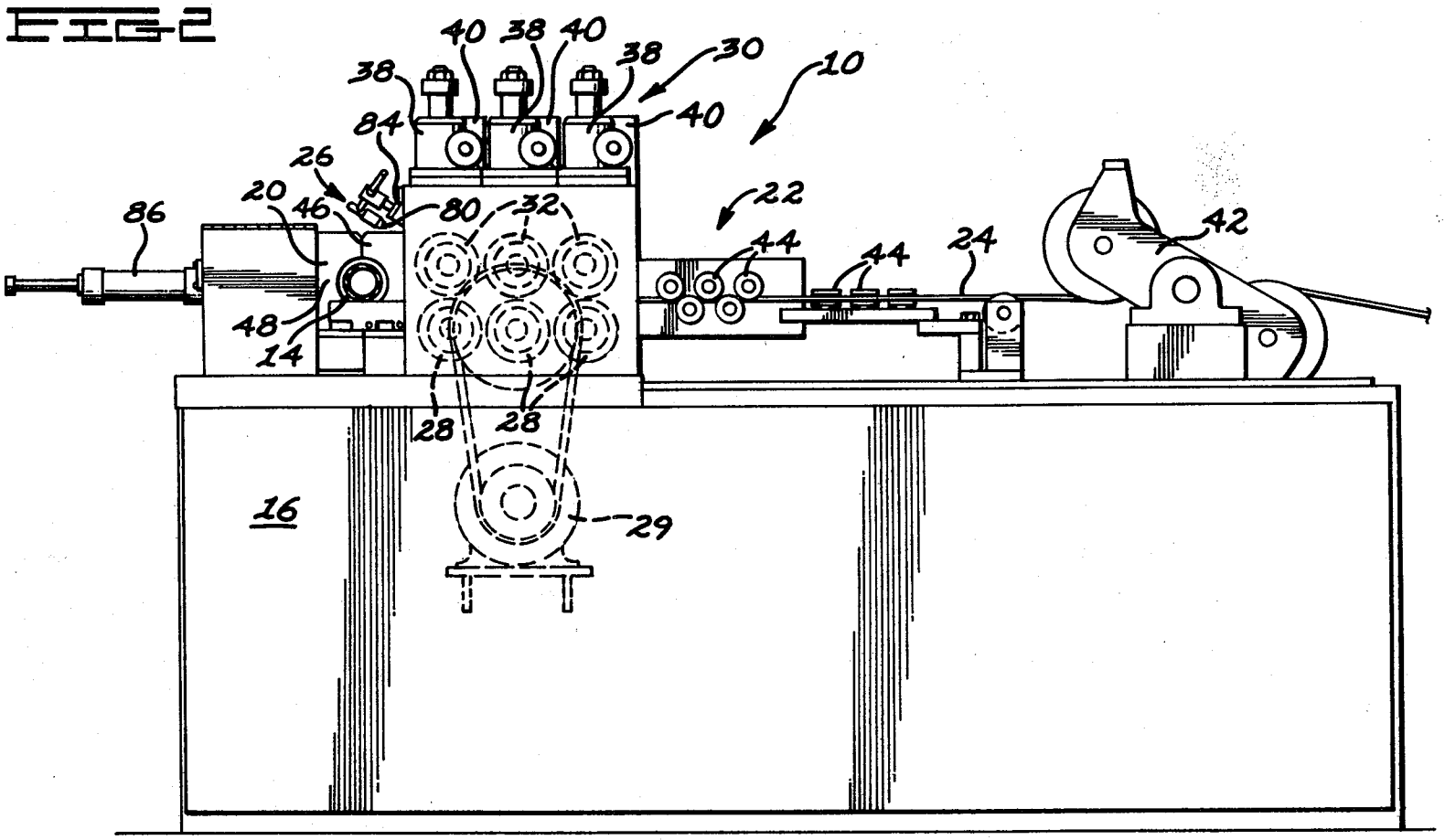
FIG. 2 is a side view of an embodiment of the apparatus of the present invention taken along the line II—II of FIG. 1.
Figure 3:
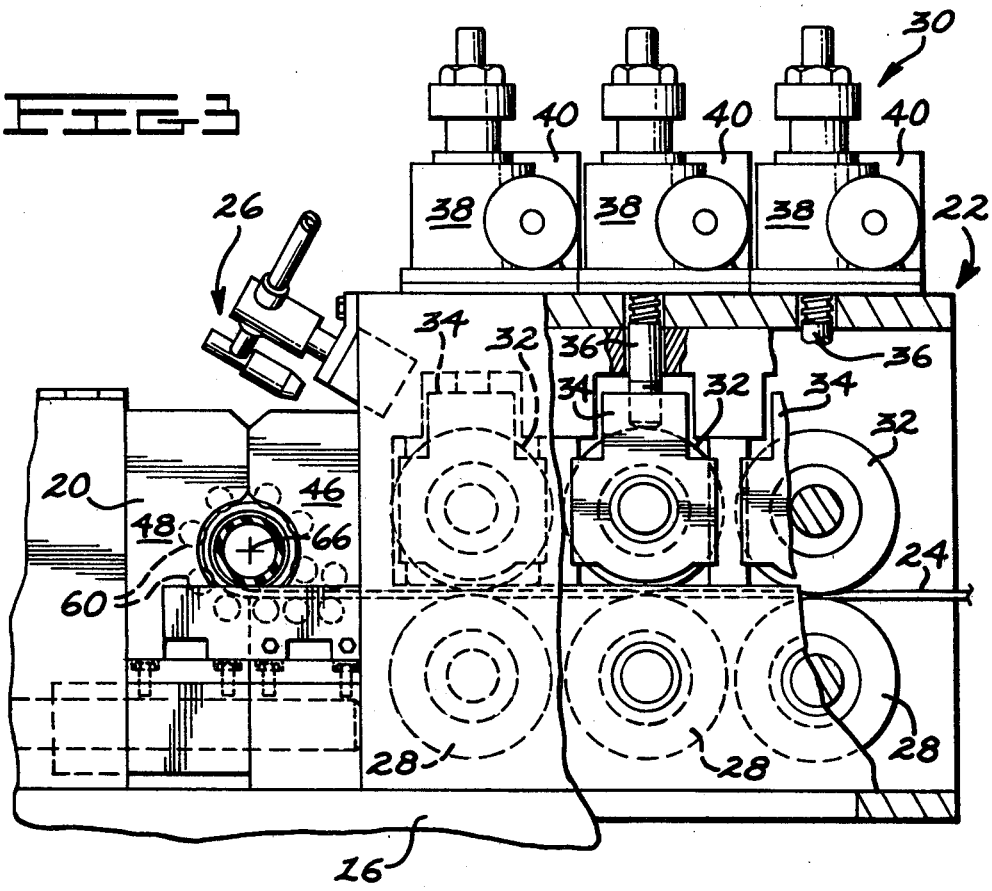
FIG. 3 is a partially-sectioned portion of the side view of FIG. 2.

An apparatus for forming an external guard member 12 on a hose 14 is generally indicated in FIG. 1 by the reference numeral 10. The apparatus 10 includes a frame 16, a first means 18 for supporting at least one of the guard member 12 or the hose 14, a forming head 20, and a second means 22 for feeding a continuous strand of guard material 24, (FIG. 2) from a supply source such as a play-off reel, not shown, to the apparatus 10 and more particularly to the forming head 20. As shown in FIGS. 2 and 3, the apparatus 10 also includes a third means 26 for cutting the strand of guard material 24.

The second means 22 for feeding a continuous strand of guard material 24 includes a plurality of driven rollers 28 and a fourth means 30 for equally urging the strand of guard material 24 into pressure contact with each of the rollers 28. The driven rollers 28 are synchronously driven in a normally counterclockwise direction, as viewed in FIG. 3, by a motor 29. The fourth means 30 for equally urging the strand of guard material 24 into pressure contact with the driven rollers 28 includes a plurality of rollers 32 each mounted in a pair of vertically adjustable journals 34 on the frame 16. Each of the rollers 32 are positioned vertically above one of the driven rollers 28 forming a plurality of mating pairs of driven rollers 28 and vertically adjustable rollers 32. Further, the driven rollers 28 and the vertically adjustable rollers 32 each have an annular groove corresponding to the shape of the guard material 24 formed in respective radially outer surfaces. Each of the journals 34 are attached to a jack screw 36 of a worm gear actuator 38 and driven by a hydraulically powered rotary actuator 40. The rotary actuators 40 are each supplied by a common source of pressurized hydraulic fluid such as a hydraulic pump, not shown, and convert fluid pressure into rotary power in either a clockwise or a counterclockwise direction. When supplied with pressurized fluid from a common manifold, each of the rotary actuators 40 have an equal output torque that is transmitted respectively through the worm gear actuators 38 and the jack screws 36 to the journals 34. Each of the rollers 32, mounted in the journals 34, are thus equally urged, depending upon the preselected power output direction of the rotary actuators 40, either downwardly into pressure contact with the guard material 24 positioned between the respective mating driven roller 28 and the vertically adjustable roller 32, or upwardly away from such contact. The magnitude of the pressure contact between the guard material 24 and the driven rollers 28 is controlled by the pressure of the hydraulic fluid equally directed to each of rotary actuators 40.

As shown in FIG. 2, the second means 22 for feeding a continuous strand of guard material also preferably includes a tension control device 42 and a plurality of straightening rollers 44.

Figure 10:
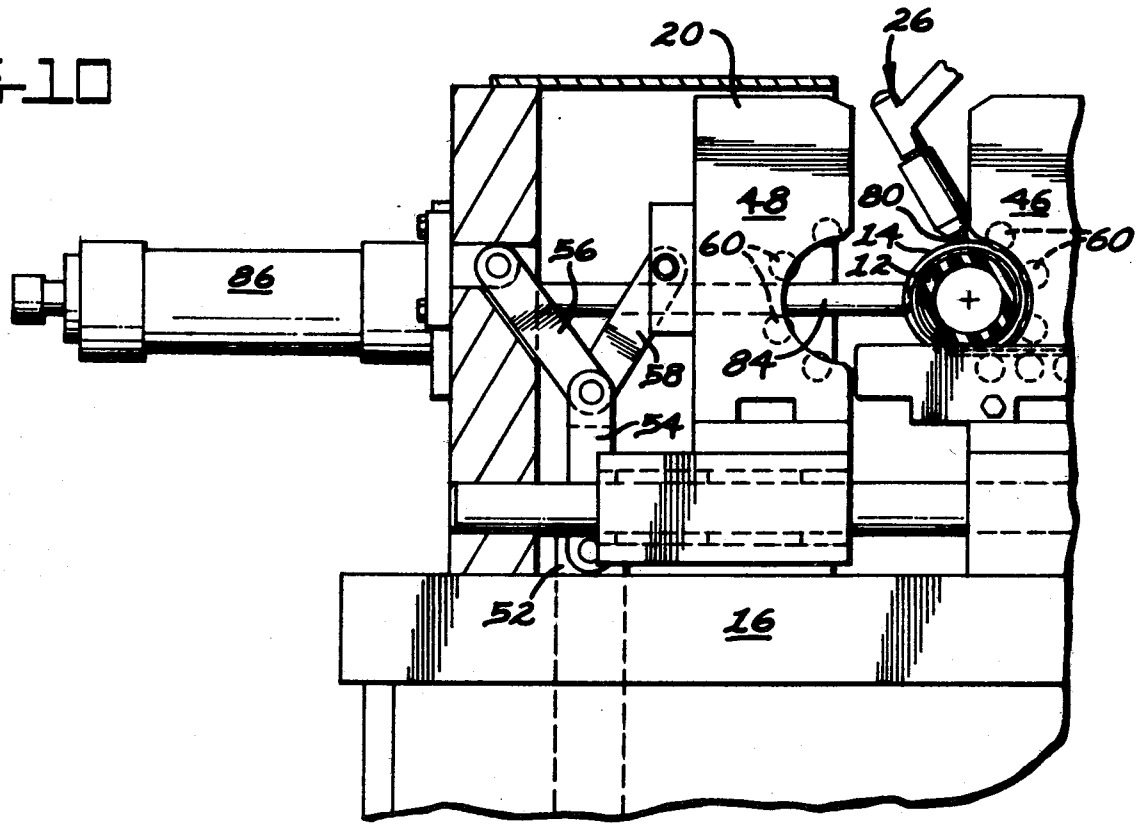
FIG. 10 is a partially-sectioned side view of an embodiment of the present invention showing the forming head in an open position.

The forming means or head 20 includes a first portion 46 removably attached in a fixed position to the frame 26 and a separable second portion 48, moveably mounted on the frame 16. The second portion 48 is moveable between a first position at which the first and second portion 46,48 are spaced apart as shown in FIG. 10 and a second position, shown in FIG. 4, at which the first and second portions 46,48 are in an abutting relationship.

Figure 4:
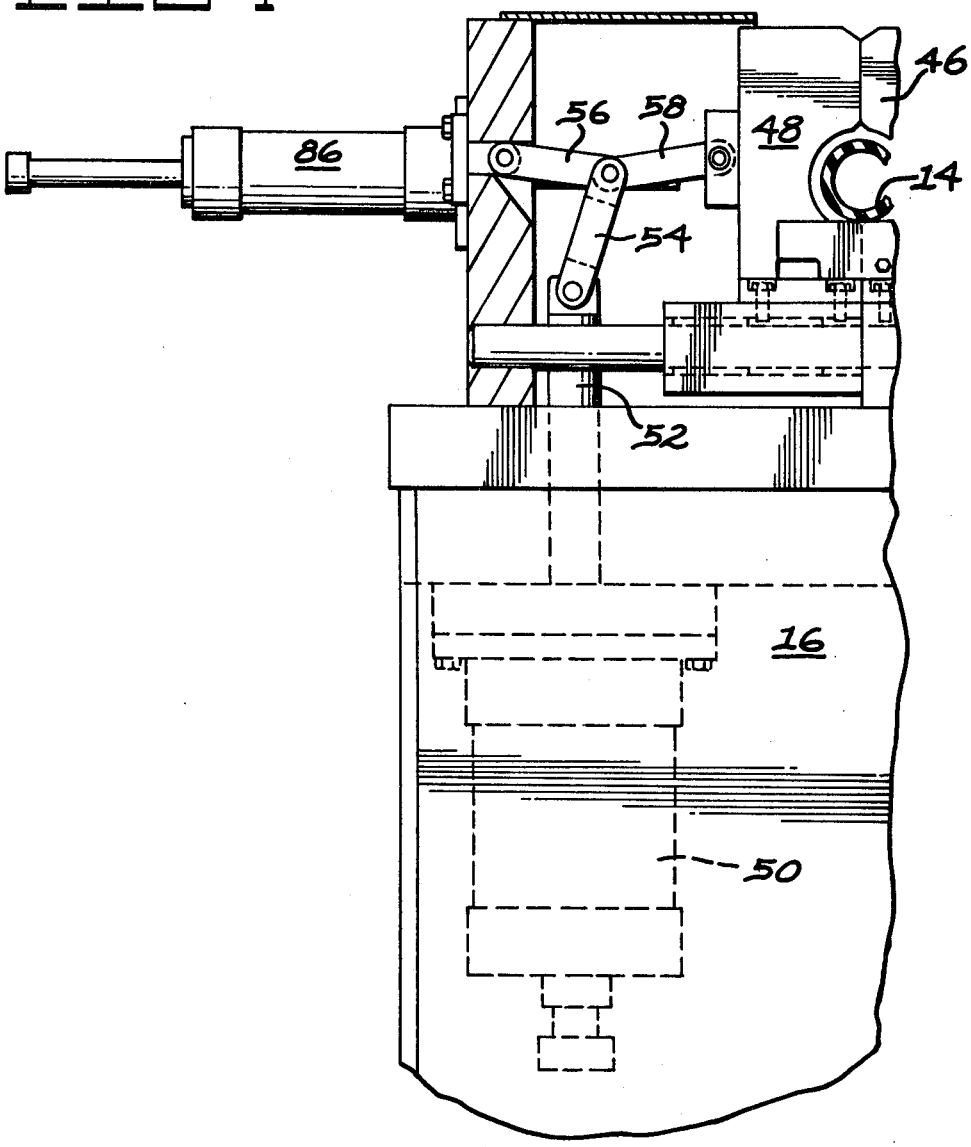
FIG. 4 is a partially-sectioned side view of another portion of FIG. 2.

As best shown in FIG. 4, a hydraulic cylinder 50 is attached to the frame 16 and has an extensible rod end 52 pivotally connected to a first link 54 of a three member linkage arrangement. The linkage arrangement also includes a second link 56 pivotally attached to a vertical member of the frame 16 and a third link 58 pivotally connected to the second portion 48 of the forming head 20. Retraction of the rod end 52 moves the first link 54 to an elevationally lower position and draws the second portion 48 of the forming head 20 to the left, as viewed in FIG. 10, to the position spaced from the fixed first portion 46. Conversely, extension of the rod end 52 moves the first link 54 to an elevationally higher position and moves the second portion 48 to the right into the abutting position, as shown in FIG. 4, in pressure contact with the first portion 46.

Figure 6:
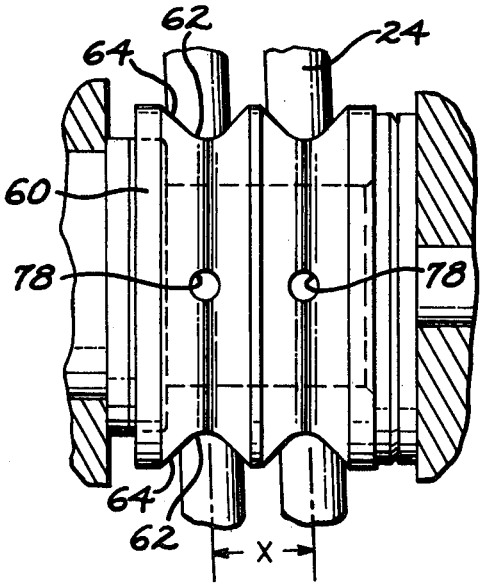
FIG. 6 is an elevational view of a die member of an embodiment of the present invention taken along the line VI—VI of FIG. 5.
Figure 5:
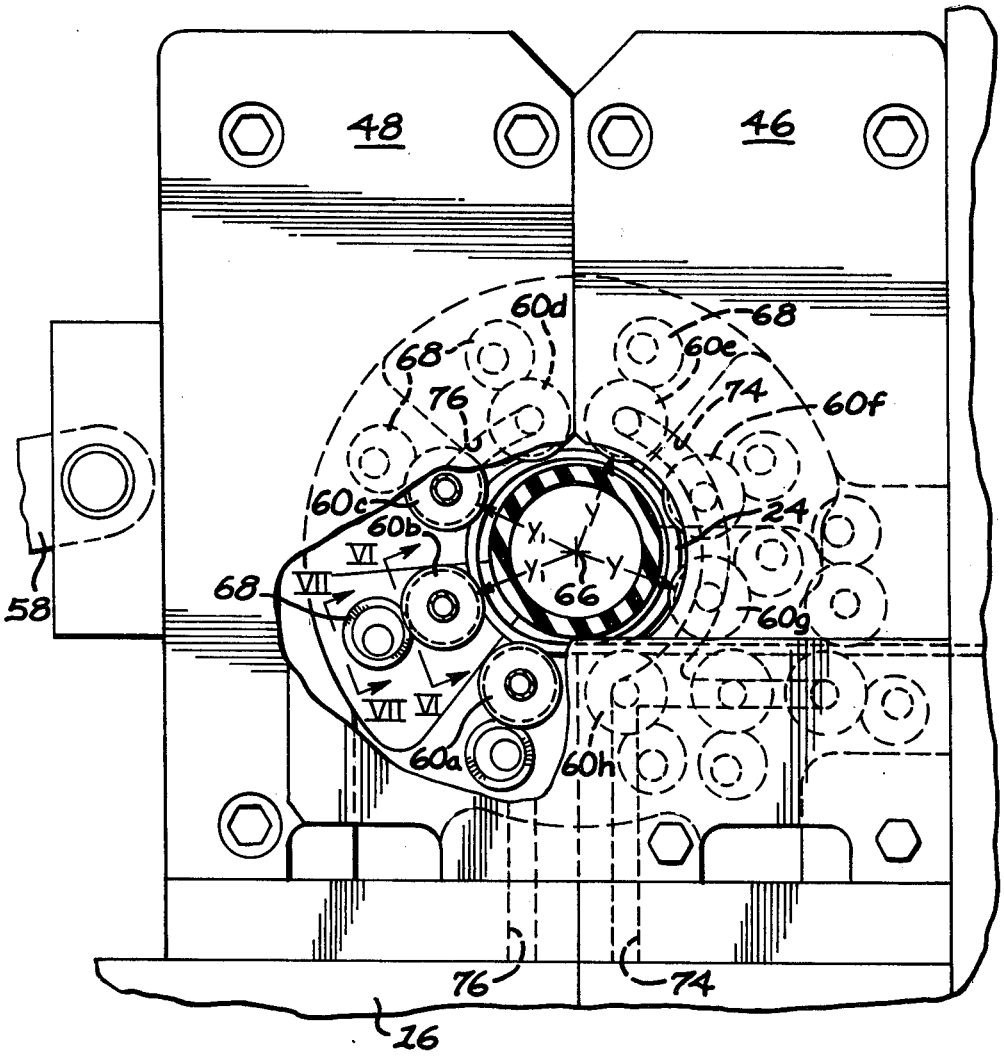
FIG. 5 is a partially-sectioned view of a forming head of an embodiment of the present invention.

A plurality of cylindrically-shaped die members 60, which as shown in FIG. 5, are alphabetically suffixed with the letters a–h, are rotatably mounted in an arcuately spaced relationship on each of the first and second positions (46,48). In the preferred embodiment, the die members are desirably constructed of a carbide steel and, as shown in FIG. 6, each have a pair of parallel annular grooves 62 circumferentially disposed on a peripheral surface 64 of the die member 60. The grooves 62 are contoured to mate with the strand of guard material 24 and are spaced apart a distance "x" equal to the pitch of adjacent coils of the formed guard member 12.

As best shown in FIG. 5, the die members **60*e*, 60*f*, and 60*g*, mounted in the first portion 46, and 60*d* mounted as the second portion 48 of the forming head 20, are equally radially spaced at a first predetermined distance "y" from a centrally disposed longitudinal axis 66. The axis 66 is congruent with the longitudinal axis of the formed guard member 12 and is represented in cross-section by the point 66 in FIG. 5. The die members 60*a*, 60*b*, and 60*c*, mounted on the second portion 48, and 60*h*, mounted on the first portion 46 of the forming head 20, are radially spaced from the longitudinal axis 66 at a second predetermined distance "y1", the second distance "y1", being greater than the first predetermined distance "y". In the preferred embodiment, a forming head 20 for forming an external guard member 12 having an internal diameter of 34.0 mm (1.34 in.) from a strand of spring steel guard material having a nominal diameter of 3.0 mm (0.12 in.), the groove surface 62 of the die members 60*d*, 60*e*, 60*f* and 60*g* are each equally radially positioned at a radius "y" of 20.1 mm (0.79 in.) from the axis 66, and die members 60*a*, 60*b*, 60*c* and 60*h* are equally radially positioned at a radius "y1" of 21.6 mm (0.85 in.) from the axis 66**.

The eight die members, **60*a*–60*h*, are also axially spaced along the centrally disposed longitudinal axis 66. The eight die members 60*a*–60*h* are each successively axially spaced, inwardly from the plane of the paper, one-eighth of the aforementioned pitch distance "x". For example, if the desired pitch distance is 5.5 mm (0.22 in.), the die member 60*b* is axially spaced one-eighth of the pitch distance or 0.7 mm (0.028 in.) from the die member 60*a*; die member 60*c* is axially spaced a distance equal to one eighth of the pitch distance or 0.7 mm (0.028 in.) from the die member 60***b;* and continuing in clockwise direction each of the successive die members 60*d*–60*h* are each progressively spaced a distance equal to one eighth the pitch distance from the respective preceeding die member.

Figure 7:
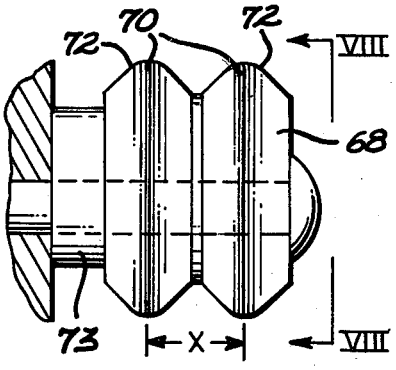
FIG. 7 is an elevational view of a roller of an embodiment of the present invention taken along the line VII—VII of FIG. 5.
Figure 8:
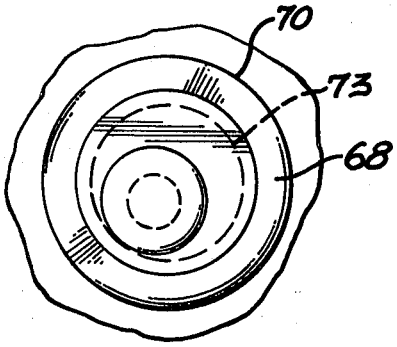
FIG. 8 is a side view of the roller of an embodiment of the present invention taken along the line VIII—VIII of FIG. 7.

The first and second portions 46,48 of the forming head 20 also have a plurality of radially adjustable rollers 68 preferably constructed of a carbide steel material and disposed in contacting relationship adjacent each of the die members 60. As best shown in FIGS. 7 and 8, the rollers 68 each have a pair of radially extending parallel flanges 70 circumferentially disposed on a peripheral surface 72 of the roller 68, and are mounted on the respective first and second portions 46,48 through an eccentric adjustable bushing 73. The radial position of each of the rollers 68, with respect to each adjacently disposed die member 60, is controlled by rotation of the eccentric bushing 73. If desired, a similar radially adjustable eccentric bushing mounting arrangement may be used to mount each of the die members on the respective first and second portions 46,48 of the forming head 20. Such a mounting arrangement allows wider construction tolerances in the fabrication of the forming head and provides a means for readjusting the die members 60 to compensate for wear during use of the apparatus 10. As an aid to reducing wear, lubricating oil is supplied to the die members 60, and more specifically to the surface of the annular grooves 62, through a pair of oil galleries 74,76 provided respectively in the first and second portions 46,48. As shown in FIG. 5, the galleries 74,76 communicate a source of pressurized lubricant, not shown, with a hollow center cavity of each of the die members 60. The lubricant is directed to each of the grooved surfaces of the die members 60 by a pair radial apertures 78 communicating between the hollow center cavity and the external surface of the die members 60.

The third means 26 (FIG. 2) for cutting the strand of guard material 24 includes an electrical resistance heated element 80. In the preferred embodiment, a TIG (tungsten-inert gas) welding head, used without shielding gas, provides a clean, rounded-end smooth cut of the spring steel wire guard material. The element 80 is pivotally mounted on the frame 16 and is moveable, by a rotary actuator 82, between a first position at which the element 80 is spaced from the guard material 24, as shown in FIG. 3, and a second position at which the element 80 is in contact with the guard material 24, as shown in FIG. 10. A clamping member 84 is slideably mounted on the frame 16 and is moveable by a hydraulic cylinder 86 between a first position at which the clamping member 84 is spaced from the formed guard member 12, and a second position at which the clamping member 84 is in pressure contact with the formed guard member 12.

Figure 9:
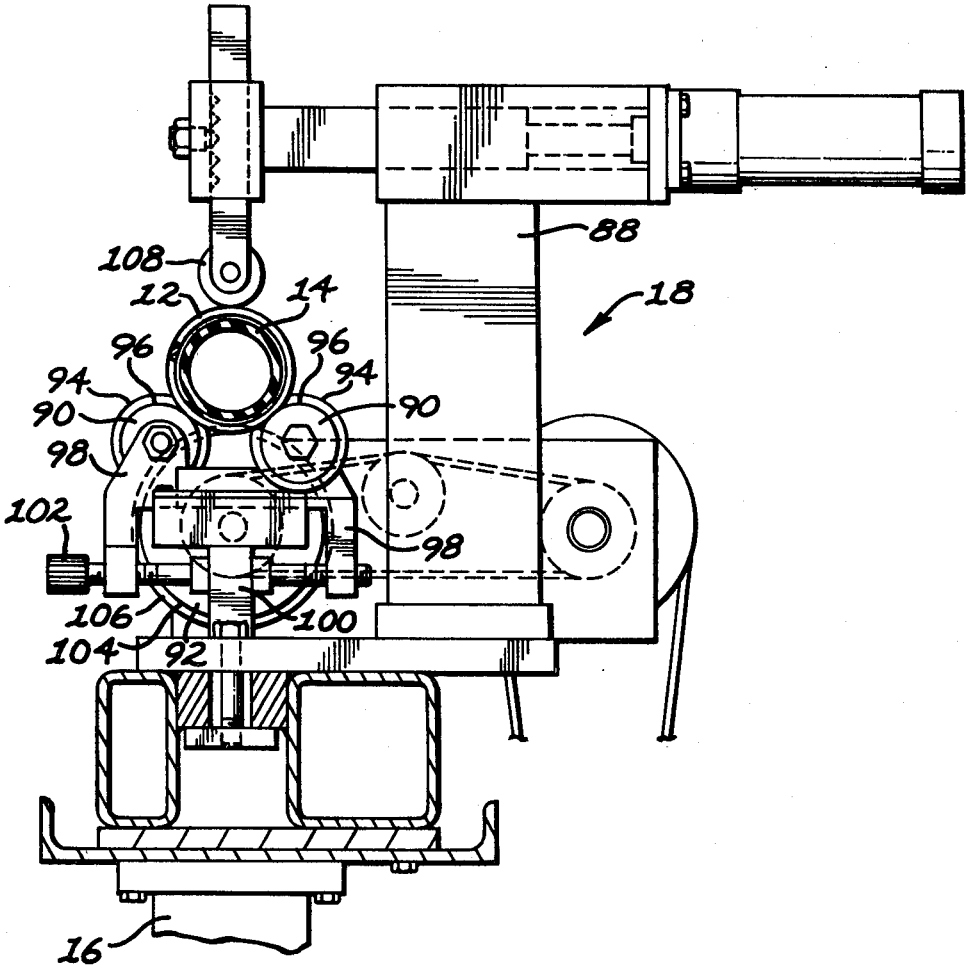
FIG. 9 is a sectional view of the apparatus of an embodiment of the present invention taken along the line IX—IX of FIG. 1.

The first means 18 for supporting at least one of the guard member 12 and the hose 14 includes a plurality of support stations 88 longitudinally adjustably spaced on the frame 16, along the axis 66, as shown in FIG. 1. As shown in FIGS. 1 and 9, each of the support stations 88 have a pair of rotatably mounted idler rollers 90 and a driven roller 92. Each of the idler rollers 90 have a hose support surface 94 and a guard member support surface 96 spaced radially inwardly of the hose support surface 94. The idler rollers are mounted on upwardly extending support arms 98 of a laterally adjustable fixture 100. The support arms 98 are selectively drawn together or spaced apart by rotation of a screw 102 having directionally opposed threads formed at spaced end portions of the screw 102. Rotation of the screw 102 in a first direction draws the pair of idler rollers 90 closer together, and rotation of the screw 102 in a second direction, opposite the first direction, spaces the rollers 90 away from each other. Each of the driven rollers have a guard member support surface 104 and a radially extending flange 106 having a width substantially equal to the space or clearance between adjacent coils of the formed guard member 12. The flange 106 extends radially outwardly a distance sufficient for the flange 106 to be positioned between and frictionally contact adjacently disposed coils of the guard member 12, but not sufficient for contacting the hose 14. The idler rollers 90 therefore support both the hose 14 and the guard member 12 in a properly spaced radial relationship, and the driven rollers 92 rotate only the guard member 12. The driven rollers 92 are driven by a variable speed motor, not shown, synchronously with the driven rollers 28 of the second means 22 for feeding a strand of guard material 24 to the forming head 20. In the preferred embodiment, a vertically and laterally adjustable roller 108 is disposed above the hose 14 and guard member 12 at each of the support stations 88. The rollers 108 limit the upward movement of the formed guard member 12 and assure engagement of the guard member 12 with the drive flange 106 of the driven rollers 92.

INDUSTRIAL APPLICABILITY

Forming an external guard member 12 on a hose 14 according to the method of the present invention is accomplished by first positioning a hose 14, preferably fully assembled with fittings installed on both ends of the hose, in the forming head 20. The apparatus 10 is prepared for this first step by moving the first portion 46 of the forming head 20 to the first, or open position and moving the adjustable rollers 108 on the support stations 88 laterally to a position spaced from vertical alignment midway between the pairs of idler rollers 90. With the apparatus 10 thus prepared, the assembled hose 14 is easily positioned in the apparatus 10 by vertically lowering the hose 14 until it is at rest on the idler rollers 90. The hose 14 is axially aligned, along the axis 66 by positioning one end of the hose 14 immediately to the right of the forming head 20, as shown in FIG. 1.

The second portion 48 of the forming head 20 is moved to the second, or closed, position in abutting contact with the first portion 46 by pressurizing hydraulic cylinder 50. After movement to the second position, the second portion 48 is maintained in contact with the first portion 46 by maintaining a flow of pressurized fluid to the hydraulic cylinder 50.

A continuous strand of guard material 24, such as round, hard drawn spring wire of SAE 1060 steel and having a nominal diameter of 3.0 mm (0.12 in.) is fed from a supply reel, not shown, through the tension control device 42, the straightening rollers 44, and the second means 22 to the forming head 20. The strand of guard material 24 is maintained in pressure contact with the plurality of driven rollers 28 of the second means 22 by directing a flow of equally pressurized hydraulic fluid from a common source to preselected ports of the rotary actuators 40. The rotary actuators 40 each provide an output torque of equal magnitude to the respective worm gear actuators 38 and hence to the jack screws 36 connected to the vertically adjustable journals 34 of the rollers 32. Accordingly, the rollers 32 are each equally urged downwardly against the strand of guard material 24, urging the guard material 24 into pressure contact with the driven rollers 28. The variable speed motor 24 synchronously drives each of the driven rollers 28 and the strand of guard material 24 is continuously and forceably directed into the forming head 20.

After entry into the forming head 20, the strand of guard material 24 is guided to the second portion 48 of the forming head by a first of the pair of annular grooves 62 formed in the die members 60*h* and 60*a*. Initially, to start the actual coil formation, an end of the strand 24 is manually raised and positioned in contact with the first groove 62 in the die member 60*b*. The drive rollers are then actuated to continue driving the strand of guard material 24 into the forming head 20, and the end of the strand progressively contacts the first groove of die members 60*c*, 60*d*, 60*e*, 60*f*, 60*g* forming a first complete coil, and then continuing on, passes radially inwardly of the second groove 62 of the die members 60*h*, 60*a*, 60*b*, and 60*c* and progressively contacts the second groove 62 of die members 60*d*, 60*e*, 60*f*, and 60*g* forming a second complete coil of the guard member 12 before exiting the forming head 20. Since the die members 60*b* and 60*c* are radially spaced at a distance "y1", greater than the radial distance "y" at which the remaining die members are positioned, the strand of guard material 24 is initially urged into a first coil shape having a first predetermined diameter as represented by the section of the first formed coil of guard material 24 extending from die member 60*a* to die member 60*c* in FIG. 5. The strand of guard material is thus initially urged into a smaller diameter coil shape than desired for the final coil diameter.

It has been found that overbending, or initially urging the guard material into the smaller than final diameter, is highly desirable in forming guard members of spring steel wire material. Further, by forming two complete coils of the guard member 12 in the forming head 20, in conjunction with the initial overbending, virtually eliminates any tendency for the formed coils to "spring back" and assume a larger than desired diameter after exiting from the forming head 20. It has been this tendency, and the problems associated with forming spring steel wire which have heretofore prohibited the in situ forming of a spring steel wire guard member about a soft mandrel, or as in the preferred embodiment of the present invention, a preassembled hydraulic hose.

It is common practice to precoat guard material, such as spring steel wire, to protect the material during storage and shipping. The coating material and other accumulated matter, however, has a tendency to rub-off and build up on the die members 60 during formation of the coil shapes. The flanges 70 of the radially adjustable rollers 68 are each positioned, prior to use of the apparatus 10, in light contact with the respective annular grooves 62 of adjacently positioned die members 60. The light contact between the carbide steel rollers 68 and carbide steel die members 60 serves to remove extraneous material from the forming surfaces of the die members 60, maintain the forming surface in a clean condition, and prolong the useful life of the die members 60. As the rollers 68 and die members 60 wear, they may be easily repositioned by rotation of the respective eccentric mounting bushing 73.

After exiting the forming head 20, the formed guard material continues to rotate about the hose 14 and advances axially towards the end of the hose opposite the forming head 20. The rotation and advancement of the guard member 20 is aided by frictional engagement of the driven rollers 92 between adjacently formed coils of the guard member 12.

Upon completion of the formation of the guard member 12, hydraulic pressure to the cylinder 50 is redirected, and the rod end 52 is retracted, returning the second portion 48 of forming head 20 to the first, or open, position at which the second portion 48 is spaced from the first portion 46. Simultaneously with retraction of the second portion 48, the cylinder 86 is pressurized and the clamping member 84 is urged into pressure contact with the formed guard member 12, as shown in FIG. 10. With the guard member 12 thus restrained in a fixed position with respect to the first portion 46 of the forming head 20, the resistance heated element 80 is rotated into contact with the first partially-formed coil of the guard material 24 and supplied with electrical current. The coil, at the point of contact with the element 80, is quickly heated to the melting temperature of the guard material 24 and the motor 29 is activated to urge the partially formed portion of the guard material 24 away from the formed guard member 12.

After cutting the strand of guard material 12, the adjustable rollers 108 are moved laterally and the hose 14, with the complete external guard member 12 formed thereabout is vertically removed from the support stations 88 and the forming head 20.

Other aspects, objects and advantages of this invention can be obtained from a study of the drawings, the disclosure and the appended claims.

We claim:

1. In an apparatus for forming a guard member on a hose, said apparatus having a frame, first means for supporting at least one of said guard member and said hose along a longitudinal axis, and second means for feeding a continuous strand of guard material from a supply source to said apparatus, the improvement comprising:

a forming head mounted on said frame for forming a coil-shaped guard member circumferentially about and radially spaced from said hose, said head having separable first and second portions and a plurality of die members rotatably mounted on respective ones of said first and said second portions in arcuate positions which are spaced relative to each other, at least two of said plurality of die members being mounted on said first portion of the forming head at an equally radially spaced predetermined first distance from said longitudinal axis, and at least one of said plurality of die members being mounted on said second portion of the forming head at a radially spaced second distance greater than said predetermined first distance from said longitudinal axis when said second portion is in an abutting relationship with respect to said first portion;

means for selectively separating said first and said second portions; and wherein said second means for feeding a continuous strand of guard material includes a plurality of driven rollers for propelling said continuous strand of guard material into pressure contact with said plurality of die members and rotating said formed coil-shaped guard member about said hose.

2. The apparatus, as set forth in claim 1, wherein the improvement includes a third means for cutting said strand of guard material after said guard member is formed on said hose.

3. The apparatus, as set forth in claim 2, wherein said third means includes an electrical resistance heated element pivotally mounted on said frame.

4. The apparatus, as set forth in claim 1, wherein said first means for supporting at least one of said guard member and said hose includes a plurality of support stations adjustably mounted on said frame, each of said stations having a pair of idler rollers and a driven roller rotatably mounted on said station.

5. An apparatus for forming an external guard member on a hose, comprising:

a frame;

first means for supporting at least one of said guard member and said hose along a longitudinal axis;

a forming head having a first portion and a second portion, said first portion being attached in a fixed position on said frame and said second portion being moveably mounted on said frame, and a plurality of die members rotatably mounted in respective ones of said first and second portions wherein at least two of said plurality of die members mounted in the first portion of said forming head are equally radially spaced at a predetermined first distance from said longitudinal axis and at least one of said plurality of die members mounted in the second portion of said forming head is radially spaced from said longitudinal axis at a distance equal to said predetermined first distance and at least one of said remaining die members mounted on said second portion is radially spaced from said longitudinal axis at a predetermined second distance, said second distance being greater than said first distance;

means for moving said second portion in a transverse direction with respect to said longitudinal axis between a first position at which said first and second portions are spaced apart and a second position at which said first and second portions are contiguous; and, second means for feeding a continuous strand of guard material from a supply source to said forming head in a transverse direction with respect to said longitudinal axis.

6. The apparatus, as set forth in claim 5, wherein said first means for supporting at least one of said guard member and said hose includes a plurality of support stations, each of said stations having a pair of idler rollers and a driven roller rotatably mounted on said station.

7. The apparatus, as set forth in claim 5, wherein each of said die members are cylindrically shaped and include a pair of circumferentially disposed, parallel, annular grooves.

8. The apparatus, as set forth in claim 5, wherein said apparatus includes a third means for cutting said strand of guard material.

9. The apparatus, as set forth in claim 5, wherein said second means for feeding a continuous strand of guard material includes a plurality of driven rollers and a fourth means for equally urging said strand of guard material into pressure contact with each of said driven rollers.

10. A method for forming an external guard member on a hose, comprising:

positioning said hose in a forming head having separable first and second portions;

moving at least one of said first and second portions to an abutting position with the other of said first and second portions;

feeding a continuous strand of guard material from a supply source to said forming head;

urging said guard material into pressure contact with at least one die member in said forming head and forming the guard material into a first coil shape having a first predetermined diameter;

subsequently urging said first formed guard material into pressure contact with at least one additional die member in said forming head and forming said guard material into a continuous spiral coil circumferentially about and radially spaced from said hose, said continuous spiral coil having a diameter greater than said first predetermined diameter; and, rotating and axially advancing said formed spiral coil with respect to said hose.

11. The method, as set forth in claim 10, including the additional steps of:

moving at least one of said first and second portions to a position spaced from the other of said portions;

cutting said continuous strand of guard material; and, removing said hose and said external guard member from said forming head.

12. The method, as set forth in claim 11, wherein the step of cutting said continuous strand of guard material includes:

clamping said external guard member in a fixed position with respect to said first portion of the forming head; and, moving a cutting element into contact with said external guard member.

13. The method, as set forth in claim 10, wherein the step of feeding a continuous strand of guard material includes passing said strand of guard material through a plurality of driven rollers and simultaneously equally urging said strand of guard material into pressure contact with said plurality of driven rollers.

* * * * *